US005665142A

United States Patent [19]

Wright

[11] Patent Number: 5,665,142

[45] Date of Patent: Sep. 9, 1997

[54] FLUE GAS CONDITIONING SYSTEM AND METHOD USING NATIVE $SO_2$ FEEDSTOCK

[75] Inventor: Robert A. Wright, Indianapolis, Ind.

[73] Assignee: Wilhelm Environmental Technologies, Inc., Indianapolis, Ind.

[21] Appl. No.: 752,727

[22] Filed: Nov. 19, 1996

Related U.S. Application Data

[63] Continuation of Ser. No. 226,712, Apr. 12, 1994, abandoned.

[51] Int. Cl.[6] ..... B03C 3/013

[52] U.S. Cl. ..... 95/58; 95/60; 96/18; 96/52; 96/74; 422/177; 423/244.09

[58] Field of Search ..... 95/58, 60, 63, 95/3, 4, 67, 73; 96/18, 26, 52, 74; 422/109, 177; 423/244.02, 244.09

[56] References Cited

U.S. PATENT DOCUMENTS

| | | | |
|---|---|---|---|
| 3,581,463 | 6/1971 | Roberts | 95/58 |
| 3,607,034 | 9/1971 | Henry | 423/522 |
| 3,665,676 | 5/1972 | McKewen | 95/4 |
| 3,899,308 | 8/1975 | Petersson | 95/66 |
| 3,993,429 | 11/1976 | Archer | 431/5 |
| 4,029,752 | 6/1977 | Cahn | 423/563 |
| 4,333,746 | 6/1982 | Southam | 96/19 |
| 4,466,815 | 8/1984 | Southam | 422/117 |
| 4,756,893 | 7/1988 | Lin | 423/244.07 |
| 4,770,674 | 9/1988 | Tellini et al. | 95/4 |
| 4,844,723 | 7/1989 | Tellini et al. | 96/18 |
| 4,931,265 | 6/1990 | Leussler | 423/244.02 |
| 4,987,839 | 1/1991 | Krigmont et al. | 96/52 X |
| 5,011,516 | 4/1991 | Altman et al. | 95/58 |
| 5,030,428 | 7/1991 | Dorr et al. | 423/215.5 |
| 5,032,154 | 7/1991 | Wright | 422/109 |
| 5,084,258 | 1/1992 | Lin | 423/243.08 |
| 5,122,162 | 6/1992 | Krigmont et al. | 95/58 X |
| 5,229,077 | 7/1993 | Bell et al. | 96/52 X |
| 5,240,470 | 8/1993 | Wright | 422/177 X |
| 5,244,642 | 9/1993 | Hankins et al. | 95/58 X |
| 5,288,309 | 2/1994 | Wright | 96/22 |

FOREIGN PATENT DOCUMENTS

| | | | |
|---|---|---|---|
| 46-2640 | 1/1971 | Japan | 96/74 |

*Primary Examiner*—Richard L. Chiesa
*Attorney, Agent, or Firm*—Ice Miller Donadio & Ryan

[57] ABSTRACT

A flue gas conditioning system and method generates and introduces sulfur trioxide into flue gas produced by a boiler to condition the flue gas before it passes through an electrostatic precipitator. Flue gas is withdrawn from the flue duct which couples the boiler to the electrostatic precipitator and cleaned to provide a source of sulfur dioxide. The withdrawn flue gas is passed through a heater and then into a catalytic converter which converts native $SO_2$ in the flue gas into $SO_3$ which is then introduced back into the flue duct to condition the flue gas. The $SO_3$ feedrate is controlled by varying the setpoint temperature at the inlet of the catalytic converter which varies the efficiency of the catalytic converter.

10 Claims, 2 Drawing Sheets

FLUE GAS CONDITIONING SYSTEM AND METHOD USING NATIVE $SO_2$ FEEDSTOCK

This application is a continuation of application Ser. No. 08/226,712, filed Apr. 12, 1994, now abondoned.

FIELD OF THE INVENTION

This invention relates to a system for treating boiler flue gas by conditioning it with sulfur trioxide to improve the removal of particulate matter contained therein by electrostatic and other means, and more particularly, to a flue gas conditioning system that utilizes native sulfur dioxide in the flue gas as the source of sulfur dioxide to be convened to sulfur trioxide.

BACKGROUND OF THE INVENTION

The increasing demand for electrical power has forced electrical utilities to bum increasing quantities of fossil fuels such as coal and oil. However, electric utilities also face increasing environmental standards imposed upon their operations by state and federal regulatory agencies that mandate reduced particulate and acid generating smoke stack emissions. To reduce acid generating emissions, electrical utilities have turned to burning low-sulfur coal in their boilers to generate the steam necessary for electric power generation. To reduce the particulate emissions, electric utilities generally use a flue gas treatment system to remove a majority of the particulate matter in the gas effluent passing out of the smoke stack. Such flue gas treatment systems typically comprise an electrostatic device such as an electrostatic precipitator or a fabric filter baghouse to remove the particulate. Such devices may also provide a source of conditioning agent to the flue gas to enhance the effectiveness of the precipitator or filter in removing the particulate.

The efficiency of an electrostatic precipitator in removing particulate matter from the boiler flue gas is partially dependent upon the electrical resistivity of the entrained particulate matter in the boiler flue gas. The entrained particulate matter expelled from a boiler fired with low-sulfur coal, i.e., coal having less than 1 percent sulfur, has been found to have a resistivity of approximately $10^{13}$ ohms/cm. It has been determined that the most efficient removal of particulate matter by electrostatic precipitation occurs when the particulate matter resistivity is approximately $10^{10}$ ohms/cm. Therefore, to obtain more effective use of an electrostatic precipitator, the resistivity of the entrained particulate matter from low-sulfur content coal must be reduced. Electrical utilities have long used conditioning agents introduced into the flue gas flow upstream of the electrostatic precipitator to reduce the resistivity of the entrained particles. Various chemicals, such as water, anhydrous ammonia, sulfuric acid, sulfur trioxide, phosphoric acid and various ammonia-bearing solutions have been used as conditioning agents.

In systems using sulfur trioxide as the conditioning agent, the sulfur trioxide is typically generated by combusting elemental sulfur in a sulfur furnace to generate sulfur dioxide. The sulfur dioxide is then passed through a catalytic converter which converts the sulfur dioxide to sulfur trioxide. A flue gas conditioning system of the type using sulfur trioxide as the conditioning agent is described in U.S. Pat. No. 5,032,154 to Robert A. Wright for a Flue Gas Conditioning System and assigned to Wilhelm Environmental Technologies, Inc., the assignee of this application. The disclosure of U.S. Pat. No. 5,032,154 is incorporated by reference.

Prior art systems have used the flue gas itself as the source of sulfur dioxide for conversion to sulfur trioxide. Flue gas generated when low sulfur coal is burned contains approximately 400 ppm to 1200 ppm of sulfur dioxide. In U.S. Pat. No. 3,581,463, a portion of the flue gas is withdrawn from the flue, electrostatically cleaned to remove particulate, then passed through a catalytic converter to generate sulfur trioxide. The sulfur trioxide is then injected back into the flue to condition the flue gas. U.S. Pat. No. 5,011,516 discloses such a system which eliminates the need to clean the withdrawn sulfur trioxide before passing it through the catalytic converter. U.S. Pat. No. 5,240,470, owned by the assignee of the invention described in this application, discloses using moving the catalytic converter into the flue duct where the flue gas flows through the catalyst and converts the $SO_2$ contained in the flue gas to $SO^3$ when conditioning agent is needed.

As is known, flue gas should not be over conditioned by injecting too much $SO_3$ into it. If flue gas is over conditioned, all the $SO_3$ does not interact with the flue gas and the excess $SO_3$ is emitted from the stack, which is undesirable. U.S. Pat. No. 5,011,516 discloses regulating the amount volume of the flue gas withdrawn for treatment with the catalyst, i.e., converted to $SO_3$. U.S. Pat. No. 5,240,470 discloses moving a catalytic converter into an operative position in the flue gas stream when conditioning agent is needed and to an inoperative position out of the flue gas stream when conditioning agent is not needed.

The problem with the above described techniques is that they require mechanical arrangements for controlling the amount of flue gas withdrawn from the flue, such as dampers or valves, or moving the catalytic converter into and out of the flue. Moreover, such control devices are less than precise.

It is an object of this invention to provide a flue gas conditioning system wherein native $SO_2$ is catalytically converted to $SO_3$ which is used to condition the flue gas and the amount of $SO_3$ produced is more precisely controlled than prior art systems by varying the temperature setpoint at the inlet of the catalytic converter.

SUMMARY OF THE INVENTION

In a flue gas conditioning system according to this invention which conditions boiler flue gas by introducing sulfur trioxide into the flue duct through which the flue gas is flowing before the flue gas passes through an electrostatic precipitator, flue gas is withdrawn from the flue duct and cleaned to provide the source of sulfur dioxide. The flue gas is passed through a heater and then into a catalytic converter which converts native $SO_2$ into $SO_3$ which is then injected back into the flue gas to condition the flue gas. The $SO_3$ feedrate is controlled by varying the setpoint temperature at the inlet of the catalytic converter which varies the efficiency of the catalytic converter.

Additional features and advantages of the invention will become apparent to those skilled in the art upon consideration of the following detailed description of a preferred embodiment of the invention, exemplifying the best mode of carrying out the invention as presently perceived. The detailed description particularly refers to the following figures in which:

DETAILED DESCRIPTION OF THE PREFERRED EMBODIMENT

Figure 1:
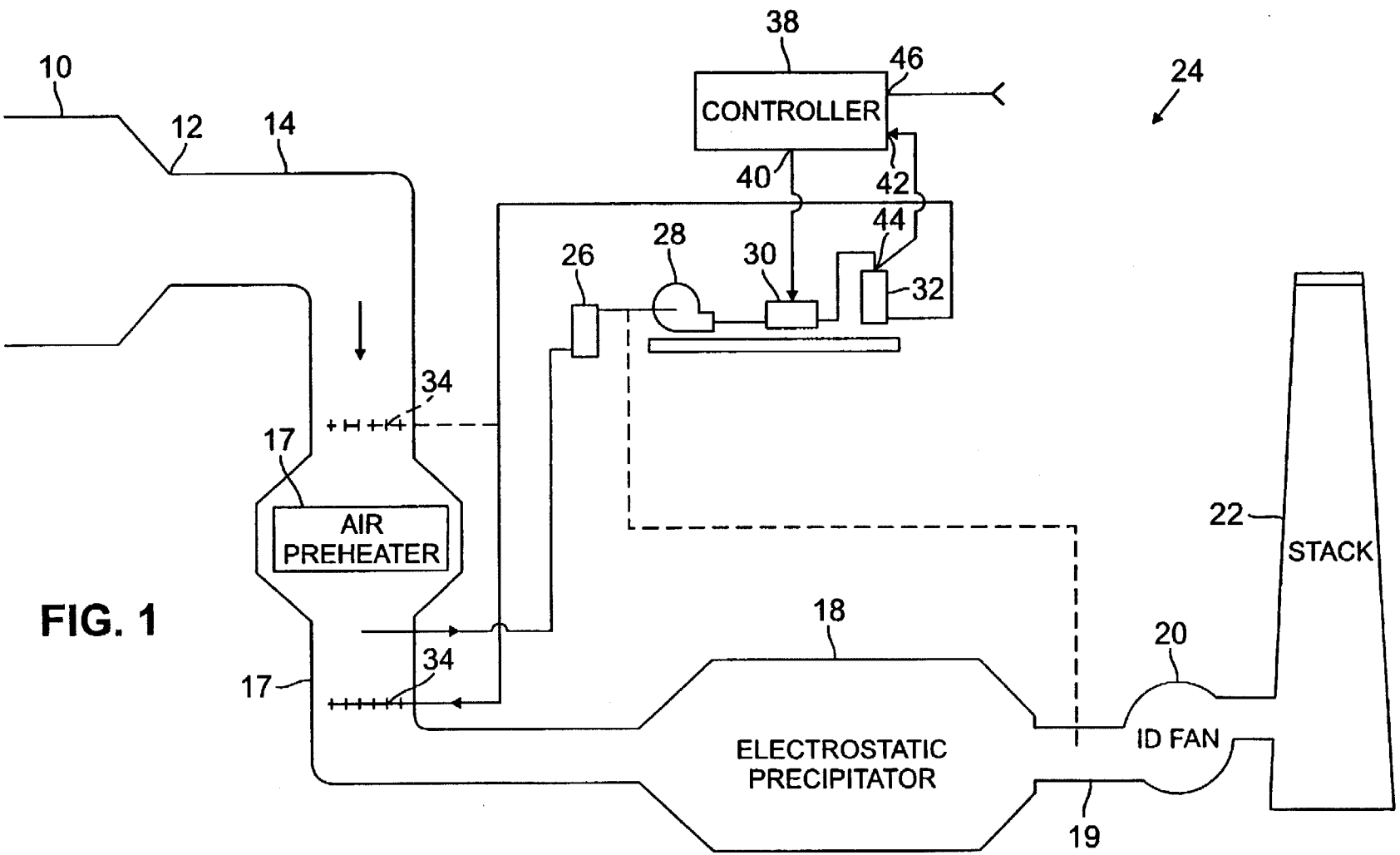
FIG. 1 is a schematic of a flue gas conditioning system according to this invention.

Referring to FIG. 1, a conventional boiler system in which the present invention may be used comprises a boiler having a fuel combustion chamber 10. An economizer 12 is coupled to the outlet of fuel combustion chamber 10 of the boiler. An outlet of economizer 12 is coupled by an economizer outlet duct 14 to an inlet of air heater 16. An outlet of air heater 16 is coupled by a duct 17 to an electrostatic precipitator 18 which removes particulate from the flue gas. An outlet of electrostatic precipitator 18 is coupled by a duct 19 to an inlet of an ID fan 20 which has an outlet coupled to a stack 22.

Flue gas exits the combustion chamber 10 of the boiler and passes through economizer section 12 exiting into economizer duct 14 at approximately 750 to 800 degrees fahrenheit. Air heater 16 transfers heat from the hot flue gas in economizer duct 14 to the air being introduced into combustion chamber 10 of the boiler in a conventional manner. A fan (not shown) conventionally forces air through the air heater 16 and into the combustion chamber 10 to provide oxygen for combustion and pressure to force the flue gas through economizer duct 14.

A flue gas conditioning system 24 according to this invention includes a bag house or filter 26 having an inlet coupled to duct 17 and an outlet coupled to an inlet of a blower 28. Alternatively, or additionally, as shown by the dashed lines, the inlet of blower 28 can be coupled to duct 19. An outlet of blower 32 is coupled to an inlet of a heater 30. An outlet of heater 30 is coupled to an inlet of a catalytic converter 32 and an outlet of catalytic converter 32 is coupled to probes 34 disposed in duct 17 downstream of air preheater 16. Alternatively or additionally, as shown by the dashed lines, the outlet of catalytic converter 32 can be coupled to probes 36 disposed in economizer duct 14 upstream of air preheater 16.

Flue gas conditioning system 24 further includes a controller 38 having an output 40 coupled to heater 30, an input 42 coupled to a temperature sensing probe 44 at the inlet of catalytic converter 32 and a control input (or inputs) 46 at which a control signal (or signals) indicative of sulfur trioxide demand is coupled. Such a control signal(s) can be signals indicative of precipitator response to flue gas conditioning, opacity, typical load signals, and the like. Illustratively, controller 38 can be a conditioning agent demand control apparatus like that disclosed in U.S. Pat. No. 5,288,309, the disclosure of which is hereby incorporated by reference. Controller 38 can also be a control means like the control means 16 disclosed in U.S. Pat. No. 5,240,470.

In operation, blower 28 draws flue gas from duct 17 through bag house 26, where the flue gas is filtered, and then blows it into heater 30. Heater 30 heats the flue gas to the desired temperature, as will be discussed later, and the flue gas is then directed into catalytic converter 32. Catalytic converter 32 converts the native $SO_2$ into $SO_3$ and the resultant mixture is then reintroduced into duct 17 through probes 34. Alternatively, or additionally, the flue gas containing $SO_3$ from catalytic converter 32 is introduced into economizer duct 14 upstream of air preheater 16 through probes 36.

The mount of $SO_3$ generated by catalytic converter 32 is controlled by controller 38. Controller 38 receives a sulfur trioxide demand control signal(s) at its input 46. Based on the control signal(s) at its input 46, controller 38 determines the optimum desired feedrate of $SO_3$ to be reintroduced back into the flue gas in duct 17 or duct 14. Typically, the feedrate of the $SO_3$ should range between 4 and 12 ppm, depending on the fuel being burned, to achieve optimum efficiency of the electrostatic precipitator. Based on this optimum desired $SO_3$ feedrate, controller 38 determines a desired inlet temperature setpoint for catalytic converter 30 and adjusts heater 30 accordingly to achieve the desired temperature at the inlet of catalytic converter 38.

Figure 2:
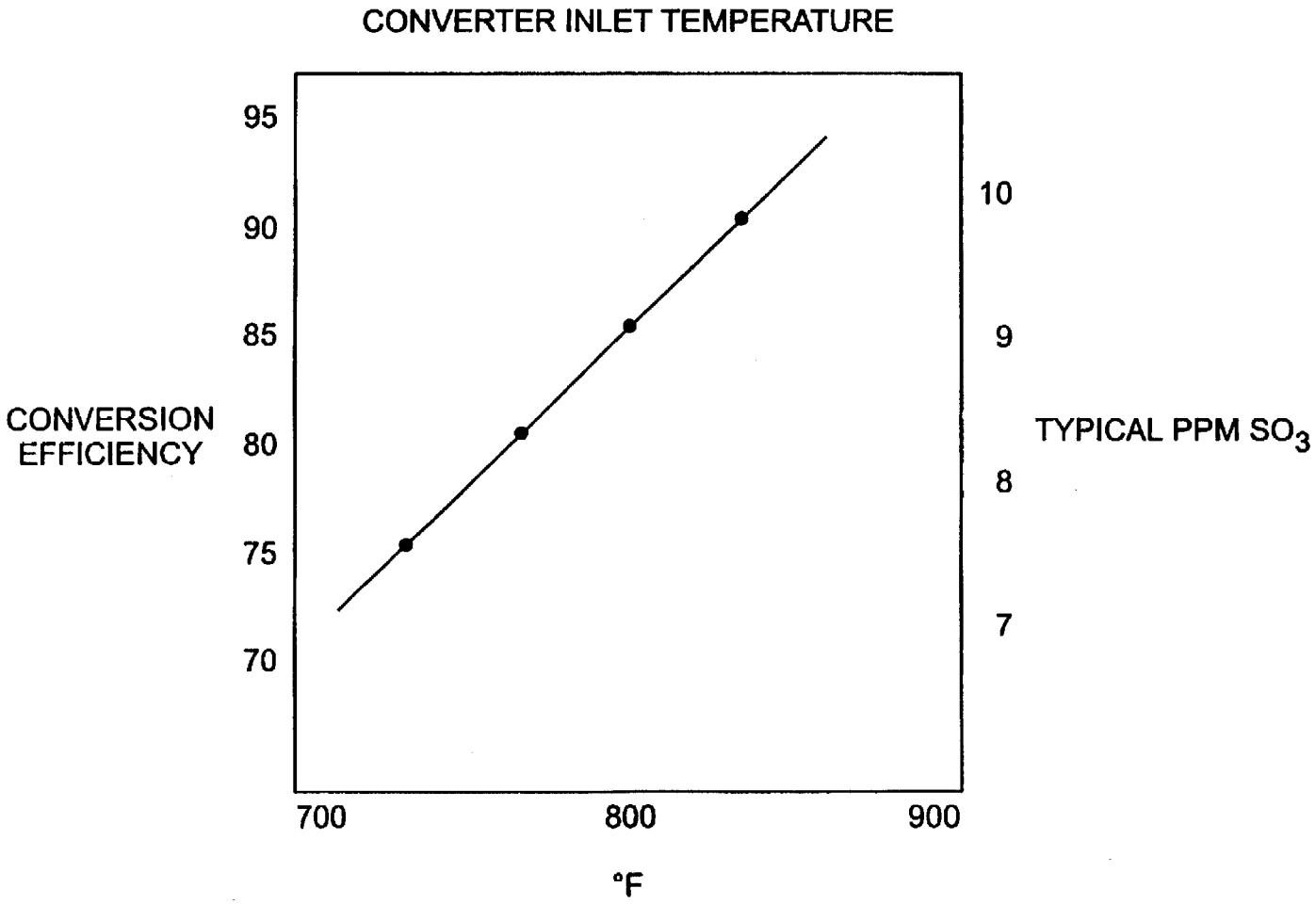
FIG. 2 is a graph showing the relationship between desired sulfur trioxide feedrate in ppm, converter efficiency, and converter inlet temperature.

The efficiency at which catalytic converter 32 converts $SO_2$ to $SO_3$ is based on the temperature at which the catalytic converter 32 operates. For catalytic converter 32 to convert $SO_2$ to $SO_3$, catalytic converter 32 must be at an operating temperature within the range of 725° F. to 1200° F. The higher the operating temperature, the greater the efficiency of catalytic converter 32. The conversion efficiency of a catalytic converter, such as catalytic converter 32, is very sensitive to catalyst temperature, so that small deviations in converter inlet temperatures cause relatively large changes in efficiency. FIG. 2 is a graph illustrating the relationship between desired sulfur trioxide feedrate in ppm, catalytic converter efficiency, and operating temperature of the catalytic converter. As illustrated in FIG. 2, if the inlet temperature setpoint of catalytic converter 32 is set to 790° F., the efficiency of catalytic converter 32 will be around eighty-five percent. If the inlet temperature setpoint is lowered to 750° F., the efficiency of catalytic converter 32 will be around seventy-five percent, or less. Consequently, by varying the temperature setpoint at the inlet of catalytic converter 32, controller 38 varies the efficiency of catalytic converter 32 thus controlling the amount or feedrate of $SO_3$ produced. Illustratively, the relationship illustrated by the graph of FIG. 2 is programmed as a look-up table into controller 38 which controller 38 uses to determine the desired inlet temperature setpoint based on the desired ppm of $SO_3$ it determined using the control signal at its input 46.

Once controller 38 determines the desired inlet temperature setpoint, it controls heater 30 to achieve and maintain the temperature at the inlet of catalytic converter 32 at this setpoint. Controller 38 monitors the temperature at the inlet of catalytic converter 32, which is sensed by temperature sensor 44 which provides a signal indicative thereof to input 42 of controller 38, and adjusts heater 30 accordingly.

As is known, the feedrate or mount of $SO_3$ that must be injected into the flue gas to achieve optimum efficiency of the electrostatic precipitator varies depending on the characteristics of the fuel (coal) being burned. The sulfur content of the coal which a utility burns varies from coal lot to coal lot which in turn varies the mount of native $SO_2$ generated when the coal is burned. Typically, the higher the amount of native $SO_2$ generated, the less conditioning agent is needed to condition the flue gas to achieve the desired resistance of the particulate matter in the flue gas for optimum efficiency of the electrostatic precipitator. This invention allows for changes in fuels and varies the $SO_3$ accordingly to greatly reduce the possibility that the flue gas is over or under conditioned.

The present invention also eliminates the need for a separate feedstock of $SO_2$. Also, since the $SO_3$ is controlled by varying the temperature setpoint at the inlet of catalytic converter 32, the flow of flue gas through flue gas conditioning system 24 can remain constant, or relatively so. In this regard, about one to one-and-one half percent of the flue gas is usually needed to be drawn into flue gas conditioning system 24 to generate the required mount of $SO_3$.

What is claimed is:

1. In a boiler system having an electrostatic precipitator and a flue gas conditioning system which conditions the flue gas by introducing sulfur trioxide into the flue duct through which the flue gas is flowing upstream of the electrostatic precipitator, an improved method for producing the sulfur trioxide comprising the steps of:

a. withdrawing a portion of the flue gas from the flue duct;

b. passing the flue gas through a catalytic converter to convert sulfur dioxide in the flue gas to sulfur trioxide;

c. introducing the sulfur trioxide generated by the catalytic converter into the flue duct upstream of the electrostatic precipitator; and d. controllably varying the temperature of the catalytic converter based on a desired sulfur trioxide feedrate to controllably vary the amount of sulfur trioxide generated by the catalytic converter.

2. The method of claim 1 wherein the step of controllably varying the temperature of the catalytic converter comprises the step of controllably varying the temperature of the flue gas that is passed through the catalytic converter.

3. The method of claim 2 wherein the step of controllably varying the temperature of the flue gas that is passed through the catalytic converter comprises heating the flue gas prior to its introduction into the catalytic converter and controllably varying the temperature to which it is heated.

4. The method of claim 3 and further including the step of determining a desired amount of sulfur trioxide to be introduced into the flue gas to condition the flue gas, determining a desired inlet setpoint temperature of the catalytic converter to achieve the generation of the determined desired amount of sulfur trioxide by the catalytic converter and controllably varying the temperature to which the flue gas that is passed through the catalytic converter is heated to achieve and maintain the temperature at the inlet of the catalytic converter at the determined desired inlet setpoint temperature.

5. The method of claim 4 and further including the step of sensing the temperature at the inlet of the catalytic converter, comparing the sensed temperature to the determined desired inlet setpoint temperature, and controllably varying the heating of the flue gas that is passed through the catalytic converter accordingly so as to achieve and maintain the temperature of the flue gas at the inlet of the catalytic converter at the desired determined setpoint temperature.

6. In a boiler system having a flue gas duct for conveying heated flue gas from a fuel combustion chamber of the boiler to an electrostatic precipitator which removes particulates from the flue gas, the boiler system further including a flue gas conditioning system for introducing sulfur trioxide into the flue gas duct upstream of the electrostatic precipitator to condition the flue gas, an improved method for controlling the amount of sulfur trioxide produced by the flue gas conditioning system comprising the steps of:

a. withdrawing a portion of the flue gas from the flue duct;

b. passing the withdrawn heated flue gas through a catalytic converter to convert sulfur dioxide in the flue gas into sulfur trioxide;

c. introducing the sulfur trioxide generated by the catalytic converter into the flue duct to condition the flue gas;

d. determining a desired inlet setpoint temperature of the catalytic converter based on a desired sulfur trioxide feedrate; and e. heating the withdrawn flue gas so that it is at the desired inlet setpoint temperature when it enters the inlet of the catalytic converter.

7. The method of claim 6 and further including the step of sensing the temperature at the inlet of the catalytic converter and controlling the temperature to which the withdrawn flue gas is heated to achieve and maintain the temperature of the flue gas at the desired inlet setpoint temperature when it enters the inlet of the catalytic converter.

8. A flue gas conditioning system for conditioning flue gas generated by a boiler prior to the flue gas passing through an electrostatic precipitator, the boiler coupled to the electrostatic precipitator by a flue duct, the flue gas conditioning system comprising:

a. a heater having an inlet coupled to the flue duct;

b. a catalytic converter having an inlet coupled to an outlet of the heater and an outlet coupled to the flue duct; and c. a controller coupled to the heater for controlling the heater, the controller having an input to which is coupled a sulfur trioxide demand signal, the controller including means for determining a desired amount of sulfur trioxide to be introduced into the flue duct to condition the flue gas based on the sulfur trioxide demand signal, means for determining a setpoint temperature for the catalytic converter based on the determined desired amount of sulfur trioxide and means for controlling the heater to heat the flue gas passing therethrough to achieve and maintain the catalytic converter at the desired setpoint temperature.

9. The apparatus of claim 8 wherein the controller's means for determining the setpoint temperature comprises means for determining desired temperature setpoint for the inlet of the catalytic converter and the controller's means for controlling the heater comprises means for controlling the heater to heat the flue gas so it is at the inlet temperature setpoint when it enters the inlet of the catalytic converter.

10. The apparatus of claim 9 and further including a temperature sensor coupled to the inlet of the catalytic converter and to a second input of the controller, the controller's means for controlling the heater includes means for comparing the temperature at the inlet of the catalytic converter sensed by the temperature sensor with the inlet temperature setpoint and controlling the heater accordingly to heat the flue gas so that it is at the inlet temperature setpoint when it enters the inlet of the catalytic converter.

* * * * *